United States Patent [19]

Johannesson

[11] 3,994,479

[45] Nov. 30, 1976

[54] SWIMMING POOL FENCE

[75] Inventor: Brian Johannesson, Waterloo, Canada

[73] Assignee: Lawrence Peska Associates, Inc., New York, N.Y. ; a part interest

[22] Filed: Feb. 9, 1976

[21] Appl. No.: 656,355

[52] U.S. Cl. ..... 256/24; 256/73; 4/172.19

[51] Int. Cl.[2] ..... E04H 17/14; E04H 17/16

[58] Field of Search ..... 256/21, 22, 24, 25, 256/73; 4/172.19, 172

[56] References Cited

UNITED STATES PATENTS 3,339,213 9/1967 Spencer ..... 256/25

3,648,303 3/1972 Stewart et al. ..... 4/172.19

*Primary Examiner*—Andrew V. Kundrat

[57] ABSTRACT

A removable fence for an above-ground swimming pool including a plurality of joinable sections. Each fence section has a plurality of upright panels which are held together to form an enclosure by transverse upper and lower pipes fastened to the panels. An upright metal post is provided at opposite ends and in the center of each fence section and has a projecting eyebolt at the bottom thereof, whose shank is used to support the fence section on the sidewall of the pool. To join the fence sections together a spring clip is positioned inside the abutting ends of the upright posts.

5 Claims, 4 Drawing Figures

SWIMMING POOL FENCE

BACKGROUND OF THE INVENTION

This invention relates to a removable fence, and more particularly, a removable fence for an above-ground swimming pool.

Most municipalities have ordinances requiring a fence to be installed around a swimming pool structure. Further, a pool owner to relieve himself of potential liability for negligence should an accident occur in his pool, must enclose the pool to preclude it from becoming an "attractive nuisance".

In order to meet this requirement, an inexpensive, portable fence would be ideal for some above-ground pools, where the pool consists of no more than a tank containing water. The fence may be disassembled for storage during winter months. Otherwise, the cost of owning such a pool might be prohibitive.

SUMMARY OF THE INVENTION

Accordingly, it is an object of this invention to provide an inexpensive, portable fence to enclose an above-ground swimming pool.

A further object of this invention is to provide a fence of the character indicated which may be installed or removed easily and quickly, in sections.

A still further object of this invention is to provide a fence of the character indicated which requires no permanent posts or foundations to erect it, and which is supported directly on the top of the pool wall.

The fence consists of a plurality of fence sections, each fence section including an upright post at each end and in the center thereof, means forming an enclosure of the space between said upright posts, means projecting from the bottom of each of the upright posts for supporting each of the fence sections on the sidewall of the swimming pool, and means for joining adjacent fence sections supported on the sidewall of the swimming pool together.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 1:
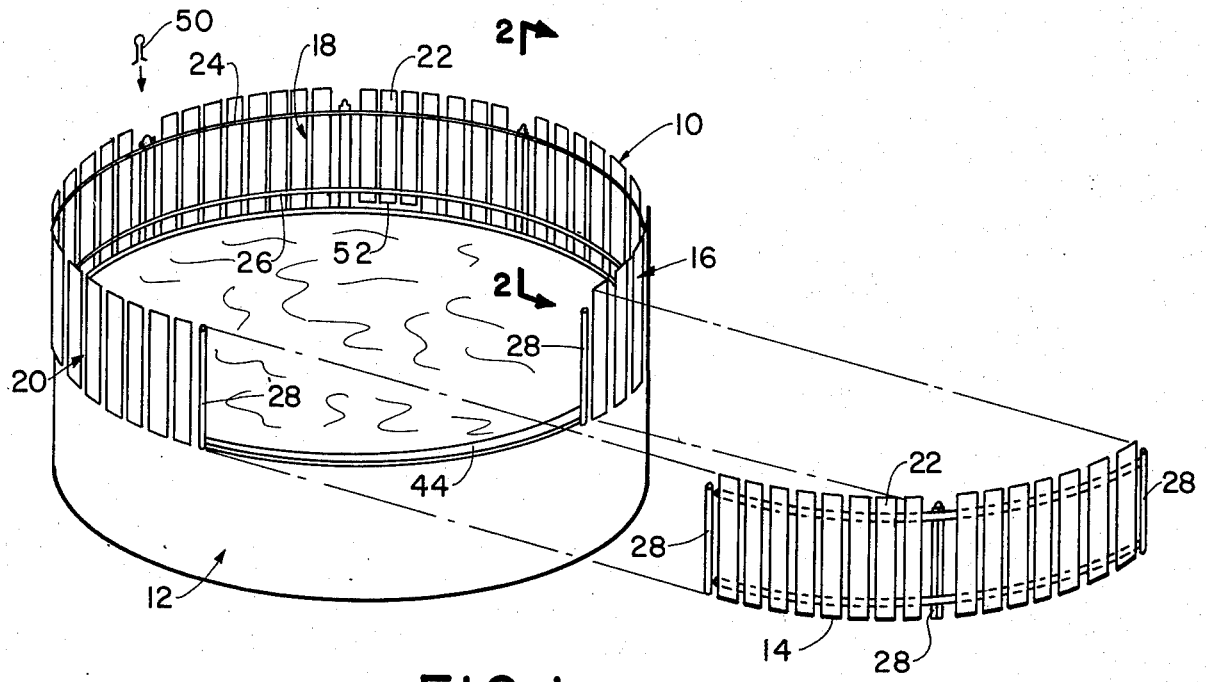
FIG. 1 is an exploded perspective view of the fence of the present invention suppoted on an above-ground swimming pool.
Figure 2:
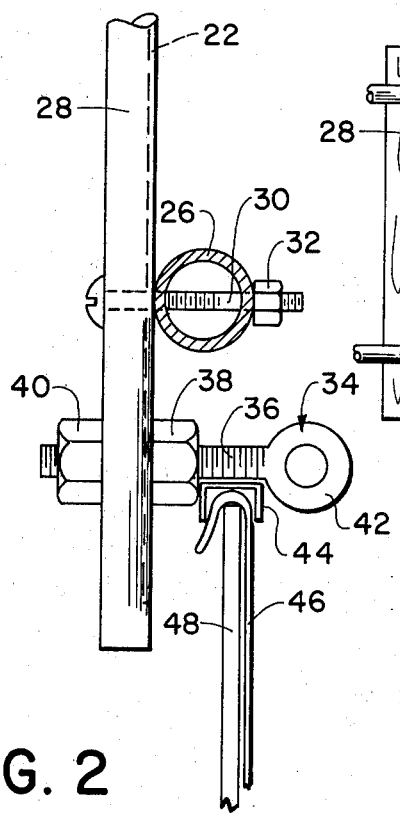
FIG. 2 is a cross-sectional view taken substantially along the plane indicated by line 2—2 of FIG. 1.

Referring now to the drawing in detail, wherein like numerals indicate like elements throughout the several views, the fence 10 of the present invention is shown in FIG. 1 enclosing an above-ground swimming pool 12.

Fence 10 is illustrated as consisting of four sections 14, 16, 18 and 20, although it will readily be understood that more or less sections may be used depending on the dimensions of pool 12 without departing from the scope of the invention. Each of the fence sections is identical in construction and has a plurality of upright plywood panels 22 joined together by an upper and lower transverse pipe or tube 24 and 26, respectively. Panels 22 are joined to th pipe 24 and 26 by conventional sheet metal screws.

An upright metal post 28 is secured to the pipes 24 and 26 at opposite ends and in the center of each fence section. As shown in FIG.. 2, a bolt 30 is inserted through each upright post 28 and each pipe 26 and 24, and secured by a nut 32 threaded onto its end extending out of the pipes.

Each metal post 28 has an eyebolt 34 extending therethrough below the juncture of the post 28 with the lower transverse pipe 26. The shank 36 of eyebolt 34 is threadedly received within a pair of nuts 38, 40 on opposite sides of metal post 28 so that the length of exposed shank 36 between the head 42 of eyebolt 34 and nut 38 may be adjusted.

When fence 10 is installed to enclose pool 12, each of the fence sections 14, 16, 18 and 20 are positioned so that the exposed shank 36 of eyebolt 34 is seated on the coping 44 of the pool 12, the coping holding the pool liner 46 in place and clamped over pool side wall 48. The head 42 of eyebolt 34 is positioned so as to face the inside of the pool 12 so that it is entirely inside the coping 44, in a vertical plane, thus also acting as a retainer to prevent the fence from being pushed off the coping.

Figure 3:
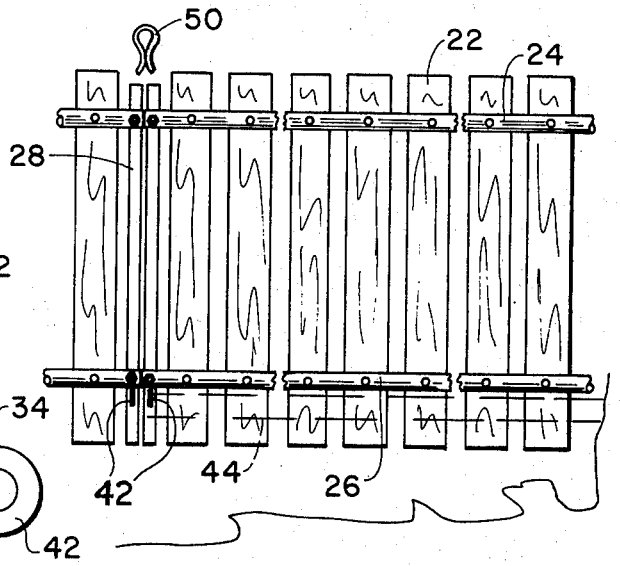
FIG. 3 is a front view in elevation from inside the pool of a portion of the fence shown in FIG. 1.
Figure 4:
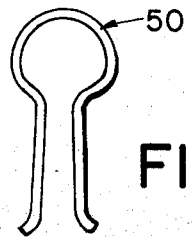
FIG. 4 is a side view in elevation of a spring clip used to fasten together sections of the fence shown in FIG. 1.

When each fence section is so seated on coping 44, metal posts 28 on the ends of adjacent fence sections will be adjacent each other, with the ends of their respective pipes 24, 26 in abutment, as shown in FIG. 3. A spring clip 50 is placed inside adjacent posts 28 to maintain the adjacent fence sections in joined relation.

To remove the fence 10, clips 50 are removed and the fence sections simply lifted off the coping 44 of pool 12 and stored. If desired, when pool 12 is in use, one section of fence 10 may be removed to provide ready access to the pool, the remaining sections being left in place as a windbreak or to assure privacy. Further, certain ones of panels 22, such as is indicated at 52 may be shorter than the others to permit access to the interior of the pool for filter pipes, hoses, or other equipment.

I claim:

1. A removable fence for an above-ground swimming pool having a sidewall comprising:

a plurality of fence sections;

each fence section including upright post at each end and in the center thereof;

means forming an enclosure of the space between said upright posts;

means projecting from the bottom of each of said upright posts for supporting each of the fence sections on the sidewall edge of said swimming pool; and means for joining adjacent fence sections supported on the sidewall of said swimming pool together.

2. A removable fence in accordance with claim 1, wherein said means forming the enclosure of the space between said upright posts include:

a plurality of upright panels; and an upper and lower transverse pipe fastened to each of said upright panels.

3. A removable fence in accordance with claim 1, wherein sad means projecting from the bottom of each of said upright posts for supporting each of said fence sections on the sidewall edge of said swimming pool includes:

a member having a head and a shank, said shank being adapted to rest on the swimming pool sidewall.

4. A removable fence in acordance with claim 3, including means on said upright post for adjusting the exposed length of said shank to fit each fence section to the exact shape and size of the pool.

5. A removable fence in accordance with claim 1, wherein said means for joining adjacent fence sections together includes:

a spring clip insertable inside adjacent ends of the upright posts of adjacent fence sections.

* * * * *